US005505135A

United States Patent [19]

Fritz et al.

[11] Patent Number: 5,505,135

[45] Date of Patent: Apr. 9, 1996

[54] LOW STRESS CASING JOINT CONFIGURATION

[75] Inventors: James E. Fritz, Ellington; Scot P. Riley, Granby, both of Conn.

[73] Assignee: The Ensign-Bickford Company, Simsbury, Conn.

[21] Appl. No.: 379,701

[22] Filed: Jan. 27, 1995

[51] Int. Cl.[6] ..... F42B 1/00

[52] U.S. Cl. ..... 102/307; 102/331; 102/332

[58] Field of Search ..... 102/307, 331, 102/332

[56] References Cited

U.S. PATENT DOCUMENTS

| | | | |
|---|---|---|---|
| Re. 31,420 | 10/1983 | Christopher | 428/546 |
| 2,698,575 | 1/1955 | Poulter | 102/24 |
| 2,974,589 | 3/1961 | Bryan | 102/20 |
| 3,078,797 | 2/1963 | Blair | 102/24 |
| 3,276,369 | 10/1966 | Bell | 102/24 |
| 3,347,164 | 10/1967 | Baks et al. | 102/24 |
| 3,636,875 | 1/1972 | Dodson | 102/20 |
| 3,659,658 | 5/1972 | Brieger | 175/4.6 |
| 4,253,523 | 3/1981 | Ibsen | 166/299 |
| 4,273,047 | 6/1981 | Rommer | 102/310 |
| 4,901,619 | 2/1990 | Sassmannshausen et al. | 86/20.12 |

OTHER PUBLICATIONS

United State Statutory Invention Registration #H 319 to Hershkowitz dated May 7, 1991.

*Primary Examiner*—Peter A. Nelson

*Attorney, Agent, or Firm*—Victor E. Libert; Frederick A. Spaeth

[57] ABSTRACT

A pulverable casing (10) includes a housing (12) which is made from a ceramic material and which defines a circular housing closure surface (18). There is a cover (14) on the housing (12). The cover (14) is also made from a ceramic material and defines a circular cover closure surface (20). Cover (14) has a rounded conical exterior surface (24) that defines a skirt angle S of about 120°. The cover closure surface (20) is dimensioned and configured to engage the housing closure surface (18) to define a housing-cover joint (22) which defines a joint angle α of about 130°. In a particular embodiment, the exterior surface (24) of the cover (14) is rounded to a radius of about 1.8 inches and has a diameter D of about 3.28 inches.

9 Claims, 3 Drawing Sheets

LOW STRESS CASING JOINT CONFIGURATION

BACKGROUND OF THE INVENTION

Field of the Invention

The present invention relates to casing for sealing explosive charges, electronic circuitry or other vulnerable articles against environmental pressures and/or contaminants, and more particularly to the configuration of a casing comprising a housing and a cover to be subjected to high external pressures. Casings of this type are known for encasing shaped charges, and they conventionally define a housing-cover joint that lies in a plane disposed at right angles to the axis of the charge.

SUMMARY OF THE INVENTION

The present invention relates to a pulverable casing assembly comprising a housing comprising a ceramic material and defining a circular housing closure surface. There is a cover on the housing, the cover comprising a ceramic material and defining a circular cover closure surface and a rounded conical exterior surface that defines a skirt angle of about 120°. The cover closure surface of the cover is dimensioned and configured to engage the housing closure surface to define a housing-cover joint defining a joint angle of about 130°.

According to one aspect of the invention, there may be adhesive in the joint to facilitate the establishment of a seal between the cover and the housing.

According to another aspect of the invention, the ceramic material may comprise alumina.

According to still another aspect of the invention, the cover may have a rounding radius-to-diameter ratio of about 0.68. In a particular embodiment, the exterior surface of the cover may be rounded to a radius of about 1.84 inches and may have a diameter of about 3.28 inches.

In various applications, the invention may provide an explosive charge disposed in a casing comprising a housing and cover as described above. Similarly, the housing may be dimensioned and configured to enclose a fireset and an associated initiation charge.

DETAILED DESCRIPTION OF THE INVENTION AND PREFERRED EMBODIMENTS THEREOF

The present invention relates to a configuration of a cover and a housing of a casing for an explosive charge, electronic circuitry or other articles vulnerable to environmental contamination. The mating surface of the cover and the housing are configured to minimize shear and tensile stresses across the housing-cover joint when the casing is subjected to high external pressures.

Figure 1:
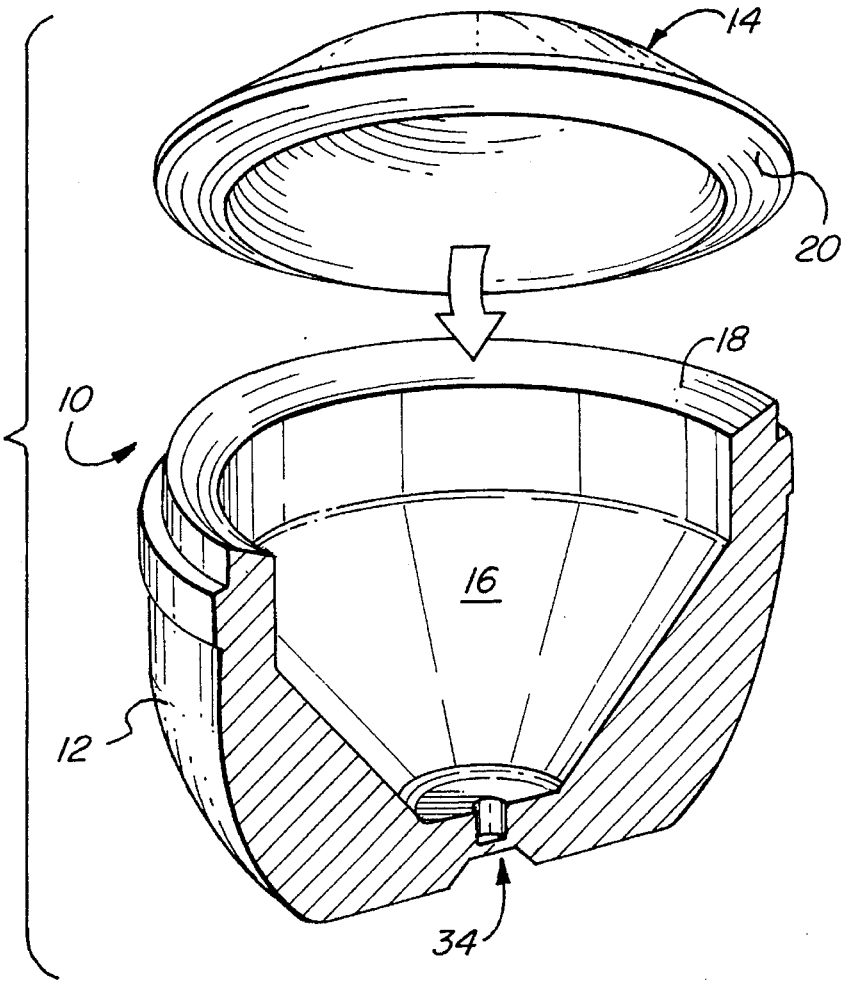
FIG. 1 is an exploded partially cross-sectional view of a casing for an explosive charge according to one embodiment of the present invention.
Figure 2:
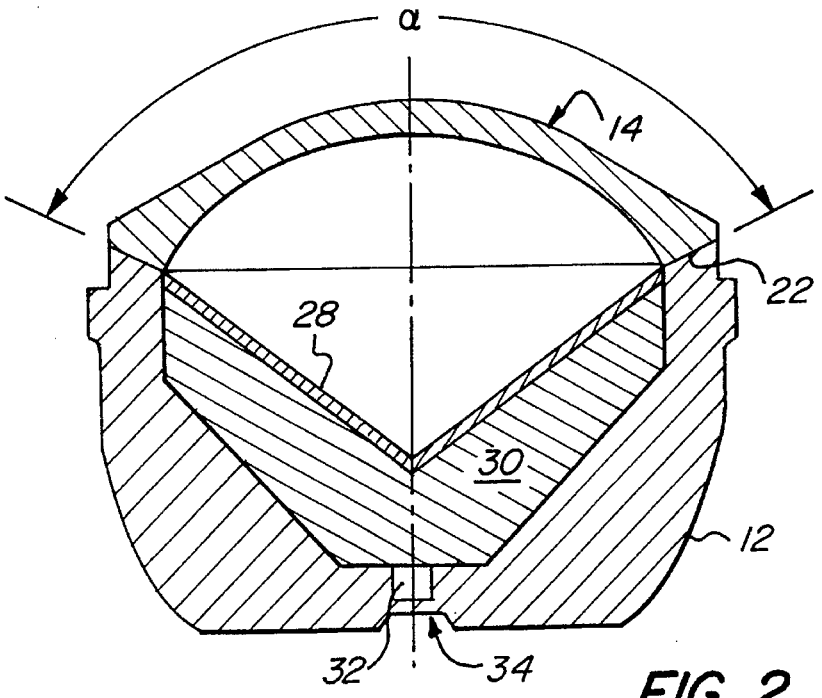
FIG. 2 is a cross-sectional view of the casing of FIG. 1 showing the cover in place on the housing and a shaped charge in the casing.

A casing in accordance with one embodiment of the present invention may encase a shaped charge as shown in FIG. 1. Casing 10 comprises a housing 12 and a cover 14 that are made from a ceramic material obtained from the Coors Ceramic Company under the trade designation AD-94 which comprises 94% alumina. Housing 12 defines a socket 16 that is dimensioned and configured to receive a shaped charge to be encased therein. Housing 12 defines a housing closure surface 18 which is a chamfer that extends around the opening of housing 12. Similarly, a chamfer on cover 14 defines a cover closure surface 20. Cover closure surface 20 is dimensioned and configured to engage housing closure surface 18, so that when cover 14 is placed upon housing 12, cover closure surface 20 engages housing closure surface 18 to define a closure joint 22 indicated in FIG. 2. As is evident from FIG. 1 housing closure surface 18 and cover closure surface 20 have circular peripheral configurations, and so does the corresponding joint 22 (FIG. 2). A sealant, such as a thin coating of an adhesive or sealing composition, can be disposed on one or both of housing closure surface 18 and cover closure surface 20 to establish a seal between cover 14 and housing 12 and to secure cover 14 on housing 12.

With the cover secured to the housing, the casing serves to protect a shaped charge comprising a liner 28, a main charge of explosive 30 and a shock-sensitive initiation charge pellet 32 from exposure to contaminants, e.g., water under high pressure, as would be encountered in deep sea demolition work or oil or natural gas recovery. The charge may be fired by detonating the pellet using an initiation signal line such as detonating cord disposed in the groove 34 near pellet 32.

Figure 3A:
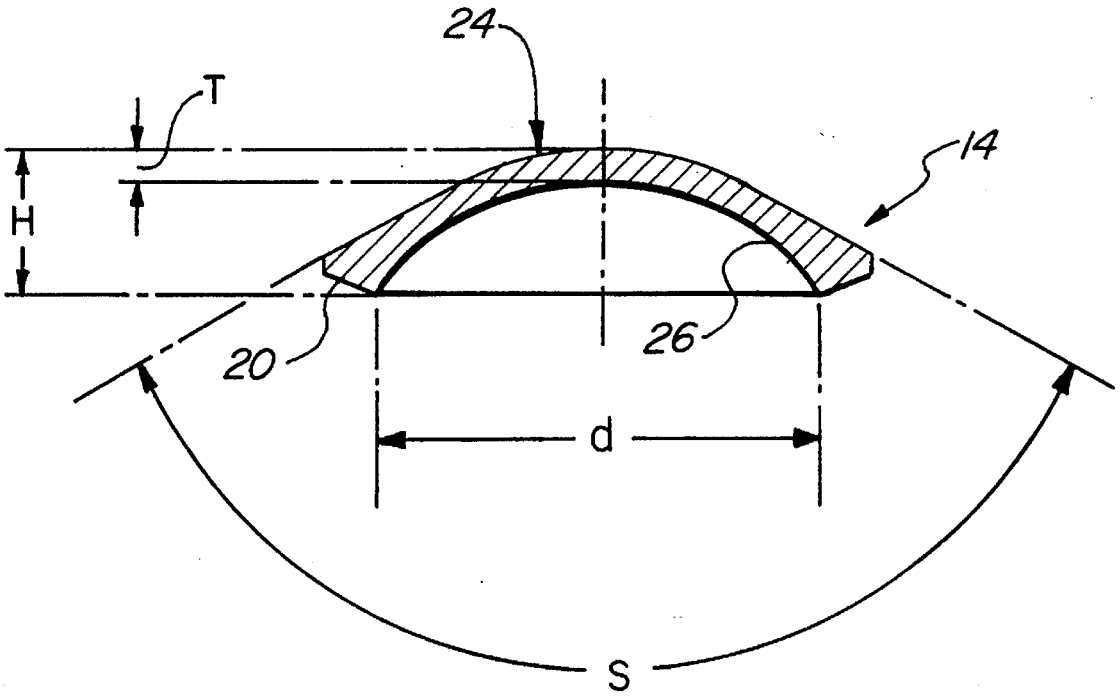
FIGS. 3A and 3B are cross-sectional and side elevational views, respectively, of the cover of the casing of FIGS. 1 and 2.
Figure 3B:
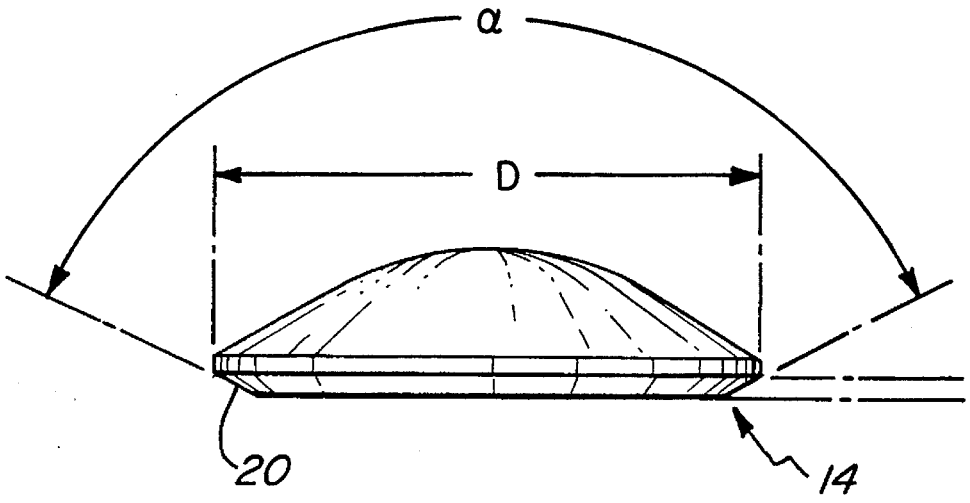

Details of the configuration of cover 14 are indicated in FIGS. 3A and 3B. The convex exterior surface 24 of cover 14 is conical near its periphery and defines a skirt angle S (FIG. 3A) of about 120°. The apex of the surface is rounded to a radius of about 1.84 inches. The diameter D (FIG. 3B) of the exterior surface is about 3.28 inches. The concave interior surface 26 of cover 14 has a radius of curvature of about 1.8 inches and defines a circular periphery having a diameter d (FIG. 3A) of about 2.7 inches. Cover 14 has a thickness T of about 0.18 inches at its apex and a height H of about 0.9 inches. Closure surface 20 is formed as a chamfer on cover 14 that defines a cone angle $\alpha$, which is the same as the joint angle of joint 22. The Applicants have determined that a superior joint can be attained between housing 12 and cover 14 by providing a joint 22 that defines the frustrum of a cone having an apex angle $\alpha$ ("joint angle") of about 130°.

The 130° joint angle is chosen to dispose the joint along a plane that closely matches the minimum principal stress surface created when the casing is subjected to high external pressure, e.g., 22,000 psi. As a result, shear and tensile stresses across the joint are minimized.

It is advantageous for housing closure surface and cover closure surface to be closely matched, but some discontinuities in these surfaces will be unavoidable. To achieve a satisfactory, pressure-resistant seal between housing 12 and cover 14, a suitable adhesive is disposed in joint 22. Epoxy adhesives having an elastic modulus of about 500,000 psi were found to provide adequate seals to pressures in excess of 22,000 psi at about 70° F. However, these adhesives failed at test temperatures of about 300° F. Ceramic adhesives, e.g., Cotronics Duralco 4540™ performed satisfactorily even at the higher temperature.

The invention provides an advantage over casings in which the housing-cover joint angle is too large or too small, since an improper joint angle will produce high shear stress and/or high tensile stresses at the mating surfaces of the housing and the cover. For example, if the joint angle is too large, e.g., 160°, the bond joint will be placed in a state of high shear stress that will cause the failure of the sealant adhesive. Once the adhesive has failed, relative motion between the housing and the cover is likely to occur, causing the cap to fail due to the high tensile circumferential stress at its outer diameter. Conversely, if the joint angle is too small, e.g., 90°, a high radial tensile stress would be induced on the housing, causing the adhesive to fail and causing structural failure of the housing.

The improved pressure and temperature resistance of casings in accordance with the present invention permit the use of encased explosive charges and/or electronic components not only in oil and gas recovery applications, but also in deep sea demolition and other recovery activities.

Figure 4:
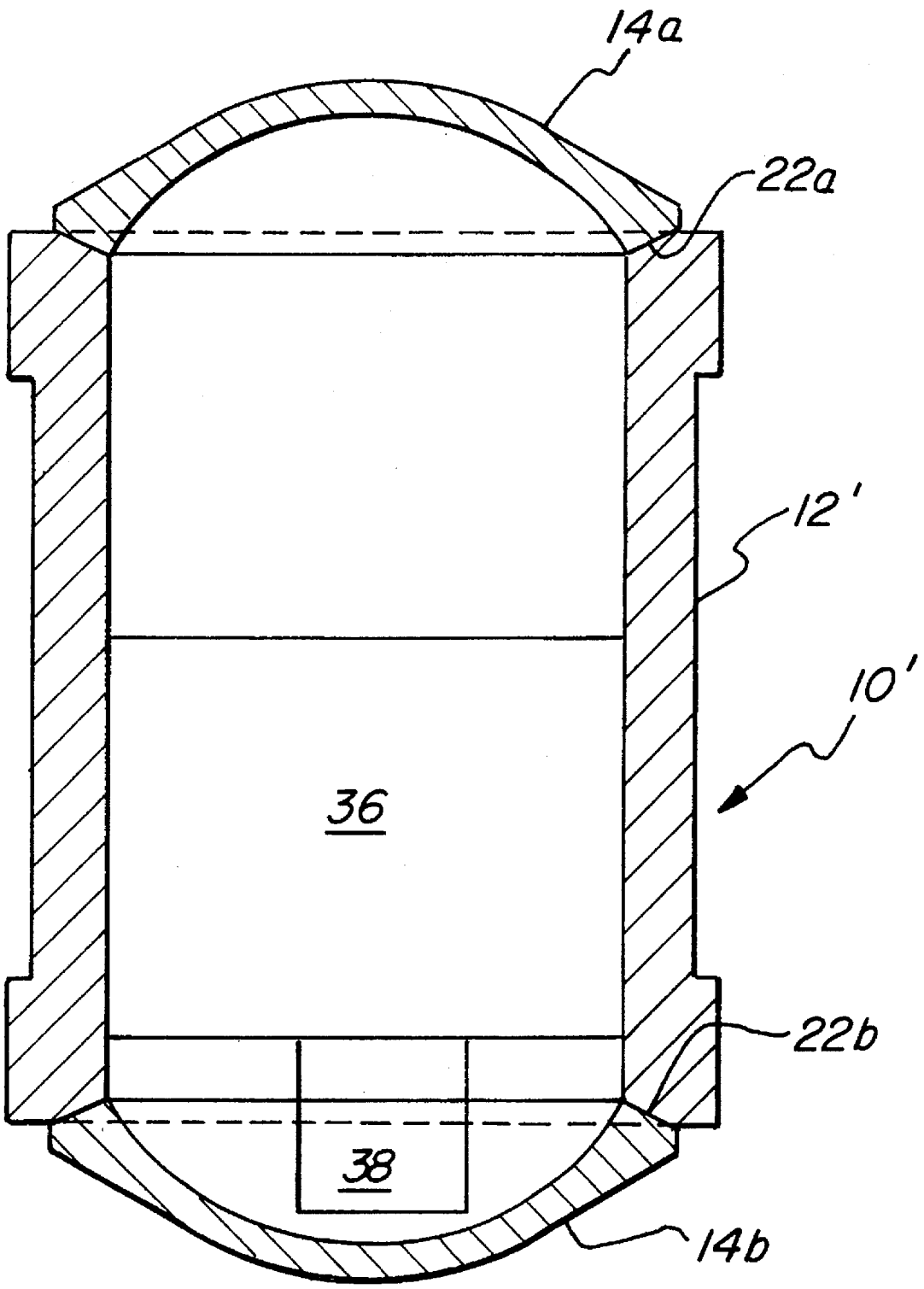
FIG. 4 is a schematic cross-sectional view of a casing in accordance with another embodiment of the present invention.

An example of a casing according to the present invention for use with electronic circuitry is shown in FIG. 4. Casing 10' comprises a housing 12' which is cylindrical in configuration and which is dimensioned and configured to have mounted therein an electronic detonating device, e.g., an electronic fireset circuit comprising a semiconductor bridge initiator. Housing 12' defines a housing closure surface at each end, and casing 10' further comprises two covers **14*a* and 14*b*, one at each end of housing 12'. Covers 14*a* and 14*b* are both configured similarly to cover 14 of casing 10. Accordingly, joints 22*a* and 22*b* formed by housing 12 and covers 14*a* and 14*b* both define joint angles of about 130°, as described above in connection with casing 10 of FIG. 1**.

Mounted within casing 10' is a detonator apparatus comprising a self-powered fireset 36 and an initiation detonation charge 38. Fireset 36 comprises a power source for detonating charge 38 and circuitry to control the firing of the charge. For example, fireset 36 may comprise a timer to fire charge 38 after a predetermined delay following a triggering event. Charge 38 has sufficient strength to initiate an initiating device, e.g., detonating cord, juxtaposed to cover **14*b***.

If necessary, an electrical connector can be employed to connect circuitry within casing 10' to a circuit element outside of casing 10', e.g., to an arming device. Preferably, this is done through the use of a thin laminate connector that is disposed within one of joints **22*a* and 22*b*, as described more fully in U.S. patent application Ser. No. 08/379,340, filed concurrently herewith, the disclosure of which is incorporated herein by reference. Briefly restated, the referenced patent application teaches the use of a thin laminate connector means comprising a plurality of thin conductive metal strips disposed on a flexible, non-conductive backing, e.g., Mylar™ polyester film. The total thickness of the laminate connector may be about 0.002 inches, and the connector may be disposed within joint 22*a*, together with a suitable adhesive, without significant adverse affect on the seal produced about joint 22*a***.

While the invention has been described in detailed with respect to a particular embodiment thereof, it will be apparent that upon a reading and understanding of the foregoing, numerous variations to the described embodiment will occur to those skilled in the art and it is intended to include such variations within the scope of the appended claims.

What is claimed is:

1. A pulverable casing assembly comprising:

a housing comprising a ceramic material and defining a circular housing closure surface;

a cover on the housing, the cover comprising a ceramic material and defining a circular cover closure surface and a rounded conical exterior surface that defines a skirt angle of about 120°;

the cover closure surface being dimensioned and configured to engage the housing closure surface to define a housing-cover joint defining a joint angle of about 130°.

2. The casing assembly of claim 1 further comprising adhesive in the joint to facilitate the establishment of a seal between the cover and the housing.

3. The casing assembly of claim 1 or claim 2 wherein the ceramic material comprises alumina.

4. The casing assembly of claim 1, claim 2 or claim 3 wherein the cover has a rounding radius-to-diameter ratio of about 0.68.

5. The casing assembly of claim 4 wherein the exterior surface of the cover is rounded to a radius of about 1.84 inches and has a diameter of about 3.28 inches.

6. An explosive penetrator comprising:

a housing comprising a ceramic material and defining a circular housing closure surface;

an explosive charge disposed in the housing;

a cover on the housing, the cover comprising a ceramic material and defining a circular closure surface and a rounded conical exterior surface that defines a skirt angle of about 120°;

the cover closure surface being dimensioned and configured to engage the housing closure surface to define a housing-cover joint, wherein the housing-cover joint defines a joint angle of from about 130°; and a layer of adhesive in the housing-cover joint to secure the cover to the housing and to provide a seal therebetween.

7. The explosive penetrator of claim 6 wherein the exterior surface of the cover is rounded to a radius of about 1.84 inches and has a diameter of about 3.28 inches, and wherein the joint angle is about 130°.

8. An encased fireset assembly comprising:

a housing comprising a ceramic material and defining a circular housing closure surface;

a fireset and an associated initiation detonating charge disposed in the housing;

a cover on the housing, the cover comprising a ceramic material and defining a circular closure surface and a rounded conical exterior surface that defines a skirt angle of about 120°;

the cover closure surface being dimensioned and configured to engage the housing closure surface to define a housing-cover joint, wherein the housing-cover joint defines a joint angle of from about 130°; and a layer of adhesive in the housing-cover joint to secure the cover to the housing and to provide a seal therebetween.

9. The fireset assembly of claim 8 wherein the exterior surface of the cover is rounded to a radius of about 1.84 inches and has a diameter of about 3.28 inches.

* * * * *